United States Patent [19]

Fanghanel

[11] 4,043,282

[45] Aug. 23, 1977

[54] TAPE EDGE CLOSING MACHINE

[75] Inventor: Peter Frederick Walter Fanghanel, Baldock, England

[73] Assignee: P. Fanghanel & Company Limited, Great Britain

[21] Appl. No.: 671,870

[22] Filed: Mar. 30, 1976

[30] Foreign Application Priority Data

Apr. 1, 1975 United Kingdom ..... 13222/75

[51] Int. Cl.[2] ..... D05B 11/00

[52] U.S. Cl. ..... 112/3 R

[58] Field of Search ..... 112/3 R, 3 A, 121.11, 112/121.12, 121.15

[56] References Cited

U.S. PATENT DOCUMENTS

| | | | |
|---|---|---|---|
| 3,083,654 | 4/1963 | Cash | 112/3 R |
| 3,233,568 | 2/1966 | Kalning | 112/3 R |
| 3,490,061 | 1/1970 | Docker | 112/3 R |
| 3,664,280 | 5/1972 | Redman et al. | 112/3 R |

*Primary Examiner*—G. V. Larkin

*Attorney, Agent, or Firm*—Blum, Moscovitz, Friedman & Kaplan

[57] ABSTRACT

This invention concerns a mattress tape edge closing machine in which a mattress support is disposed at or near 45° to the horizontal and is associated with a sewing head arranged to sew in or near the vertical mode the support and the sewing head being relatively moveable so that each part of the edge of a mattress carried by the support may be brought successively into register with the sewing head.

8 Claims, 5 Drawing Figures

3
4
5
-5-
-18-
-18-
-73-
-74-
-81-
-82
70
71
72
72
73
77
78
79
80
84
86
86
86
86
17

TAPE EDGE CLOSING MACHINE

BACKGROUND OF THE INVENTION

This invention relates to mattress making machinery and in particular to a tape edge closing machine.

It is well known to close a mattress by sewing along its top edge thereby joining the edge of the panel to the edge of the border boxing with the interposition of a reinforcing tape. As the panel and the border boxing are mutually at right angles the general practice has been to locate the mattress on a horizontal table and to incline the sewing head at an acute angle thereto. The optimum angle is 45° but in practice it has been found possible to close a mattress satisfactorily within a range of angles above and below 45°. Generally, the sewing head is driven around the periphery of the table and very considerable skill is required by an operator who must simultaneously manually pull together the edges to be sewn and at the same time jointly pull these edges into a tape binder to be embraced by reinforcing tape and sewn by the sewing head. This operation involves the operator in bending sideways over the mattress, pulling the material of the panel towards him with an elbow, walking backwards in advance of the sewing head and generally controlling the speed of movement of the sewing head with his knee.

In recent years the construction of mattresses has become increasingly more sophisticated resulting in their being firmer particularly at their edges so making the operator's task even more difficult.

Numerous attempts have been made to improve the basic machine outlined above.

For example, various modifications have been proposed to the mattress supporting table so as to compress the mattress in a direction towards the edge being sewn. This relieves the operator of much of the strain of pulling the panel material towards him with his elbow.

Machines have also been produced in which the sewing head is mounted on a carriage also capable of carrying the operator with the intention of reducing the fatigue involved in constantly walking backwards and also enabling the speed of the carriage to be controlled by a foot pedal instead of by the operator's knee. However, when the carriage moves around the corner of the mattress the operator is inevitably moved away from this corner preventing him from bending closely over the top of the material being sewn, which is necessary for satisfactory mattress closing and in consequence such machines have been generally discontinued.

There is also being produced a machine in which the horizontal mattress table revolves about a vertical axis with the operator seated on a platform carrying an inclined sewing head, the platform being arranged to move through a quarter turn independently of the table as the latter moves a corner of the mattress past the sewing head. In this arrangement the mattress is also compressed from top to bottom and the sewing head arranged to float inwardly and outwardly of the mattress periphery. Compression of the mattress results in production of slack in the material of the panel and of the box border being sewn and in the floating movement of the sewing head readily permitted sewing of the long and short sides of a rectangular mattress.

While this was satisfactory for a single width and length of mattress it would not satisfactorily accommodate the kind of tolerances in panel cutting that must be accepted and again it has been discontinued.

The difficulties set out above and the various attempts made to design machines to overcome them indicate that operators of such machines prefer to be able to move about and not remain seated at a station fixed relative to the sewing head. In the manufacture of mattresses the standards of material cutting and assembly are comparatively low and result in tape edge operators being expected to be able to join together two edges of differing length. The ability to gain or lose material either in the panel or the box separates the skilled from the unskilled operator and in order to exercise maximum skill the operator needs to be able to move about and adjust the materials while sewing.

SUMMARY OF THE INVENTION

It is an object of the present invention to provide an improved tape edge closing machine which facilitates the work of an operator.

According to one aspect of the present invention there is provided a mattress tape edge closing machine comprising a mattress support disposed at an acute angle preferably at or near 45° to the horizontal and a sewing head arranged to sew in or near the vertical mode and means for causing each part of the edge of the support to be brought successively into register with the sewing head. The machine may comprise a table carrying a mattress support, and a sewing head arranged to sew in or near the vertical mode and moveable around the periphery of the table, the mattress support being disposed at an acute angle preferably at or near 45° to the horizontal and being pivotally moveable above the table so that successive parts of the edge of the support are brought into register with corresponding parts of the edge of the table in synchronism with movement of the sewing head therearound.

Alternatively, the machine may comprise a sewing head fixedly mounted to sew in or near the vertical mode and a mattress support disposed at an acute angle preferably at or near 45° to the horizontal and being continuously rotatable in the same plane so that each part of its edge successively registers with the sewing head.

According to another aspect of the present invention there is provided a mattress tape edge closing machine comprising a mattress support and a sewing head, means for bringing each part of the edge of the support and the sewing head into register, the support comprising an open topped box having a floor moveable from a position at the bottom of the box to a position at the top of the box.

BRIEF DESCRIPTION OF DRAWINGS

The above and other aspects of the invention will now be described by way of example with reference to the accompanying drawings in which.

DESCRIPTION OF PREFERRED EMBODIMENTS

Figure 1:
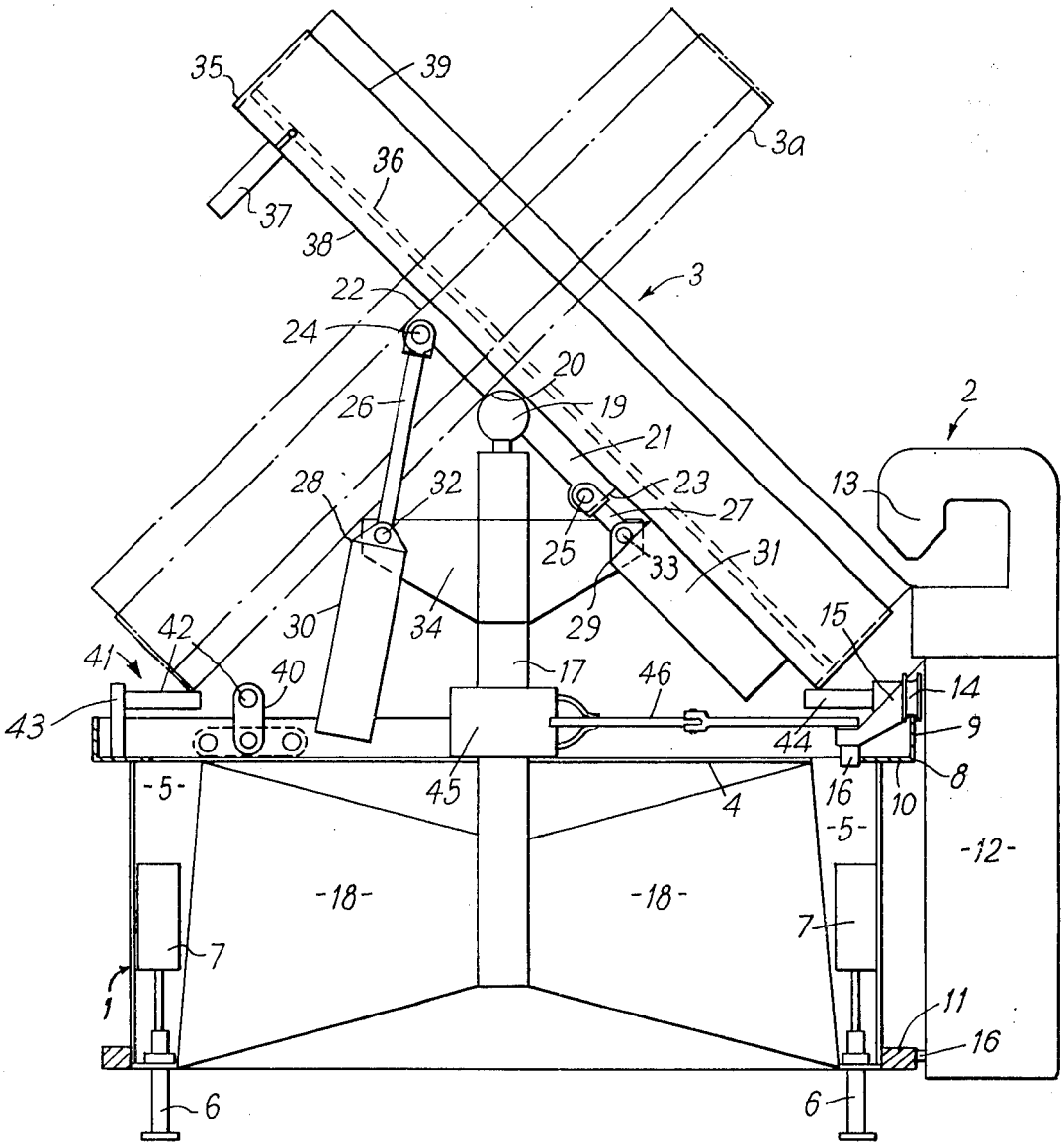
FIG. 1 shows diagrammatically one form of tape edge closing machine in end elevation.

Referring to FIG. 1 a mattress tape edge closing machine comprises a table indicated generally at 1, a sewing machine indicated generally at 2 and a rectangular mattress support indicated generally at 3. The table 1 has a horizontally disposed rectangular top 4 supported on legs such as 5 incorporating feet 6 which may be raised or lowered by pneumatic or hydraulic cylinders 7 to locate the sewing machine 2 at the most convenient height for a particular operator.

A track indicated generally at 8 extends around the periphery of the table top 4 and has a vertical part 9 and a horizontal part 10. An additional track 11 extends around the lower part of the table. The tracks are rectangular with curved corners (see FIG. 5).

The sewing machine 2 is mounted upon a carrier 12 so that its sewing head 13 is arranged to effect a stitching operation in the vertical mode. The carrier 12 is provided with a pair of carriage wheels one of which is shown at 14 to engage over the upper edge of the vertical part 9 of the track 8 and carries an arm 15 extending inwardly from the carrier 12 and at its inner end carries a wheel 16 for engagement with the inner edge of the horizontal part 10 of the track 8. At its lower end the carrier 12 has a wheel or skid 16 for engagement around the track 11. The table 1 is provided with an outwardly facing rack (not shown) with quadrants at each corner for engagement with a driven gear (not shown) on the carrier 12 to drive the latter around the table in known manner.

The table 1 is provided with a central vertical extending support pillar 17 carried by members 18 secured to the legs 5. The upper end of the pillar 17 is provided with a ball 19 engaging a socket 20 in a rectangular base plate 21. At its opposed edges 22 and 23 the base plate 21 is respectively pivoted at 24 and 25 to the piston rods 26 and 27 of fluid operated piston and cylinder motors 28 and 29, the cylinders 30 and 31 of which are respectively pivoted at 32 and 33 to a carrier 34 mounted on the pillar 17.

The mattress support 3 which extending at the preferred acute angle of 45° to the horizontal is secured to the base 21 and comprises a hollow rectangular framework 35 and a floor 36 moveable under the action of fluid operated piston and cylinder motors such as 37 between a position adjacent the lower edge 38 of the framework 35 to a position adjacent the upper edge 39 of this framework.

It will be apparent that with the arrangement above described selective operation of the motors 28 and 29 can move the mattress support 3 from its full line position in FIG. 1 to the chain line position indicated at **3*a*. In addition two further fluid operated piston and cylinder motors (not shown) are carried by the carrier 34 to tilt the mattress support 3** in directions mutually at right angles to the movement above described.

Towards each end of its side edges the table top 4 is provided with a roller assembly one of which is shown at 40 and another of which is shown at 41. Each assembly has a freely rotatable roller 42 carried at one end of an arm 43 pivoted at its other end to the table and urged by a spring (not shown) into its upright position. It will be understood that the machine has eight such assembles located two along each side edge of the table top 4. The carrier 12 carries a similar, freely rotatable roller 44 at the same height as the rollers 42.

The pillar 17 is hollow and carries a rotatable boss 45 which is linked through a hinged mechanism 46 with the carrier 12. The boss and hinged mechanism serve to supply operative services such as electricity or high pressure air or liquid under pressure to the moveable carrier 12 in known manner.

In operation a mattress to have its edges taped and stitched is located within the support 3 with the floor 36 of the latter disposed so that the upper surface of the mattress projects outwardly of the support. The latter is located as shown in full lines in FIG. 1 with its lowermost edge resting upon two of the rollers 42 and upon the roller 44. The carrier 12 is located approximately midway of its associated side edge of the table 1 so that the appropriate edge of the mattress is in stitching position beneath the head 13. It will here be understood that the carrier 12 also supports a tape dispenser (not shown) operable in conjunction with the sewing machine in known manner. The carriage is driven around the track with an operator walking backwards in advance of it. When the carriage reaches and turns the first corner of the track the motors such as 28 and 29 are operated to roll the mattress support around the ball and socket 19, 20 until the next succeeding edge of the support is in register with its corresponding edge of the table 1. In each of its rest positions the support 3 is carried by the joint 19, 20 and has its lower edge resting on the rollers 42. As the carrier moves around the track 8 the roller 44 carried thereon reaches each of the assemblies 40 in turn and temporarily carries part of the weight of the mattress support 3 as the arm 15 passes over the roller 42 by deflecting the assembly 41.

At each corner the support 3 will roll about an axis extending between the ball 19 and the roller 44 on the carrier 12. The speed with which the support rolls around the corner will be controlled by selectively passing the exhaust from the cylinders such as 30, 31 through a governor valve (not shown) coupled with the drive means for the carrier 12.

Figure 2:
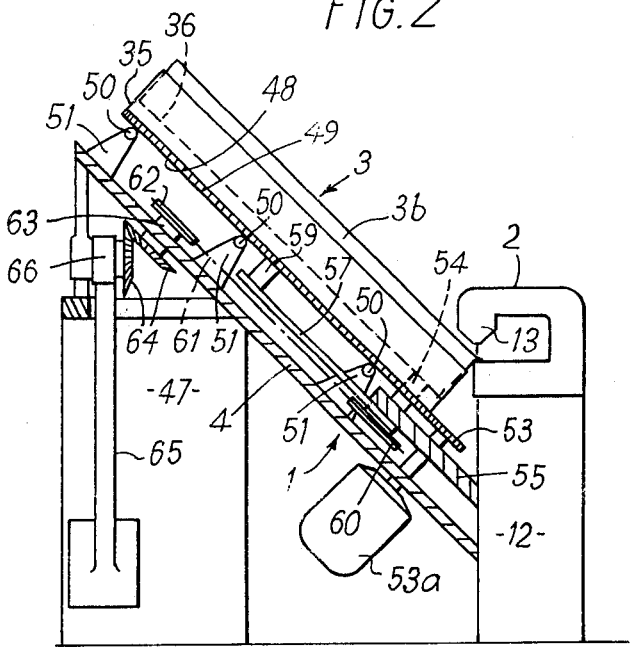
FIG. 2 is a view similar to FIG. 1 of another arrangement.
Figure 3:
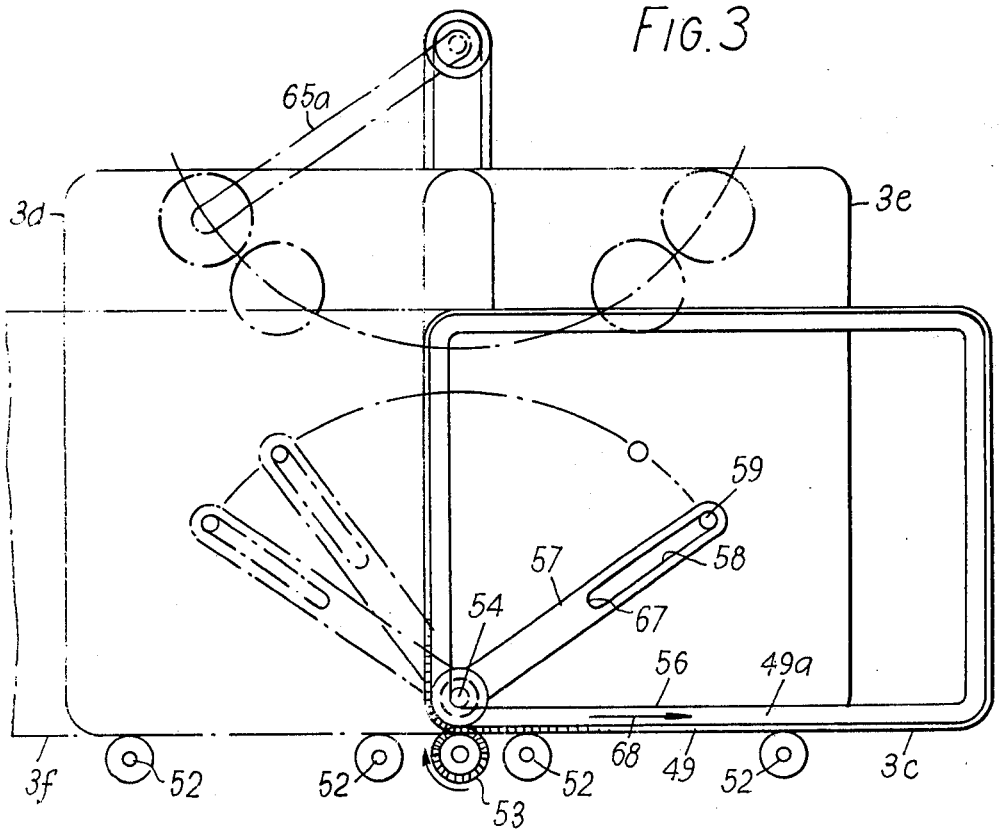
FIG. 3 is an expanded plan view of part of the machine of FIG. 2 and FIG. 4 and 5 show diagrammatically a rear perspective view and a side view of a modified mechanism for the machine of FIG. 1.

FIGS. 2 and 3 of the drawings show another arrangement in which the sewing machine 2 is mounted on a stationary carrier 12 with the sewing head 13 arranged to sew in the vertical mode. The table 1 has its top 4 inclined downwardly at the preferred angle of 45° to the horizontal between a support structure 47 and the carrier 12.

The mattress support 3 is of the same general form as in FIG. 1 comprising a hollow rectangular framework 35 and a moveable floor 36, but in the arrangement of FIGS. 2 and 3 the framework 35 is supported on a flat base plate 48 which carries beneath it a continuous toothed rack 49 joined at each corner by a toothed quadrant.

The base plate 48 rests upon a plurality of casters or rotatable balls 50 supported by pillars 51 carried on the table top 4. Although only three pillars are shown in FIG. 2 a considerable number of these are provided on the table top at appropriately spaced positions in order that the mattres support 3 may constantly rest on a sufficient number to remain stable during movement of the support to be described later. The lower edge of the support 3 is maintained at a pre-determined distance from the carrier 12 by engagement with freely rotatable rollers 52 shown only in FIG. 3. The rack 49 engages with a toothed drive wheel 53 driven by a motor **53*a*, the drive wheel being located approximately centrally of the lower part of the table 1**.

The rack 49 is formed round the outer edge of a hollow rectangular frame 49*a* (FIG. 3) beneath the base 48 and a spindle 54 rotatable in a bearing carried by a fixed member 55 is also disposed centrally of the table 1 to engage with the inner surface 56 of the frame 54 at a position opposite the drive wheel 53 so as to maintain the rack 49 in engagement with this wheel.

The lower end of the spindle 54 projects below the member 55 and carries freely rotatably one end of a link 57 formed towards its other end with a longitudinal slot 58 (FIG. 3) engaging over a fixed pin 59 extending centrally from the base plate 48. Below the link and rotatable on the spindle 54 is carried a sprocket 60 coupled to the link 57 and coupled by an endless chain 61 with a similarly sized sprocket 62 carried at one end of the shaft 63 rotatably supported in a bearing (not shown) in the table top 4. The other end of the shaft 63 is connected through gearing 64 with a pendulum 65 pivotable in a vertical plane about its upper end 66.

In operation a mattress 3*b* is located in the support 3 with the floor 36 so adjusted as to bring the top edge of the mattress into a convenient sewing position beneath the sewing head 13. The apparatus is arranged so that at the commencement of the stitching operation the support 3 is located symmetrically of the sewing machine 2 so that sewing starts midway along one side edge of the mattress. In this position the link 57 extends symmetrically of the table top 4 with the pin 59 engaging at the end 67 of the slot 58 and the pendulum 65 is disposed vertically. When the motor 53*a* is energized to rotate the drive wheel 53 the latter, by engagement with the rack 49, drives the support 3 in the direction of the arrow 68 towards the position indicated at 3*c* in FIG. 3.

In this position the link 57 has been moved by the pin 59 to the position shown in full lines in FIG. 3. Rotation of the spindle 54 through the chain 61 and gearing 64 has at the same time rotated the pendulum 65 to the position illustrated at 65*a* in FIG. 3. Further rotation of the drive wheel 53 causes the entire mattress support 3 to pivot around the spindle 54 towards the position indicated by the outline 3*d* in FIG. 3. During this quarter turn of the mattress support 3 its weight is counterbalanced by downward movement of the pendulum 65. The stitching operation then continues along the next succeeding edge of the mattress and at the mid point of this edge the link 57 again extends symmetrically of the table top 4 and the pendulum 65 is vertical. It will be understood that the support 3 then moves to the position indicated by the outline 3*e* by sliding on the balls 50 and guided by the rollers 52. Thus the next succeeding corner will be engaged by the spindle 54 and the drive wheel 53 to move the support to the position indicated by the outline 3*f.*

During the movements above described the link 57 is moved alternately in opposite directions and induces an equal and opposite movement of the pendulum 65 so as to constantly balance the weight of the mattress support 3 carrying the mattress 3*b* whenever these parts move away from the position of symmetry on the table top 4. When the sewing is completed the spindle 54 is retracted to enable the entire mattress support to be moved away from the sewing head 2 to facilitate loading and unloading.

The basic structure of FIGS. 2 and 3 may be employed with considerable simplification for the sewing of circular mattresses. In such cases it is not necessary to move the mattress support 3 laterally with respect to the table top 4 and the support can further be carried on a central spindle and rotated relative to the sewing machine 2. Accordingly for this purpose the counterweight pendulum mechanism is not required.

Figure 4:
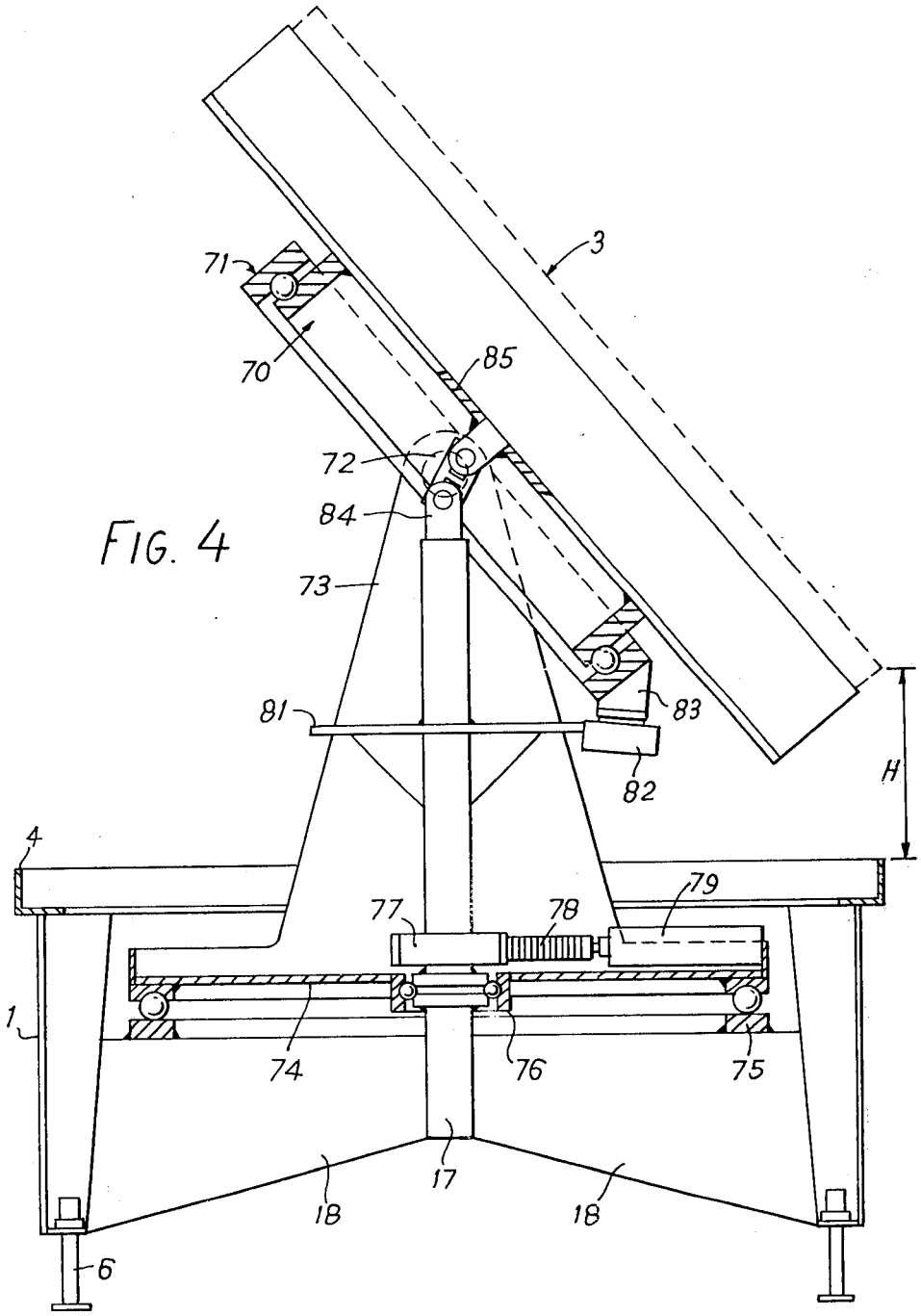
Figure 5:
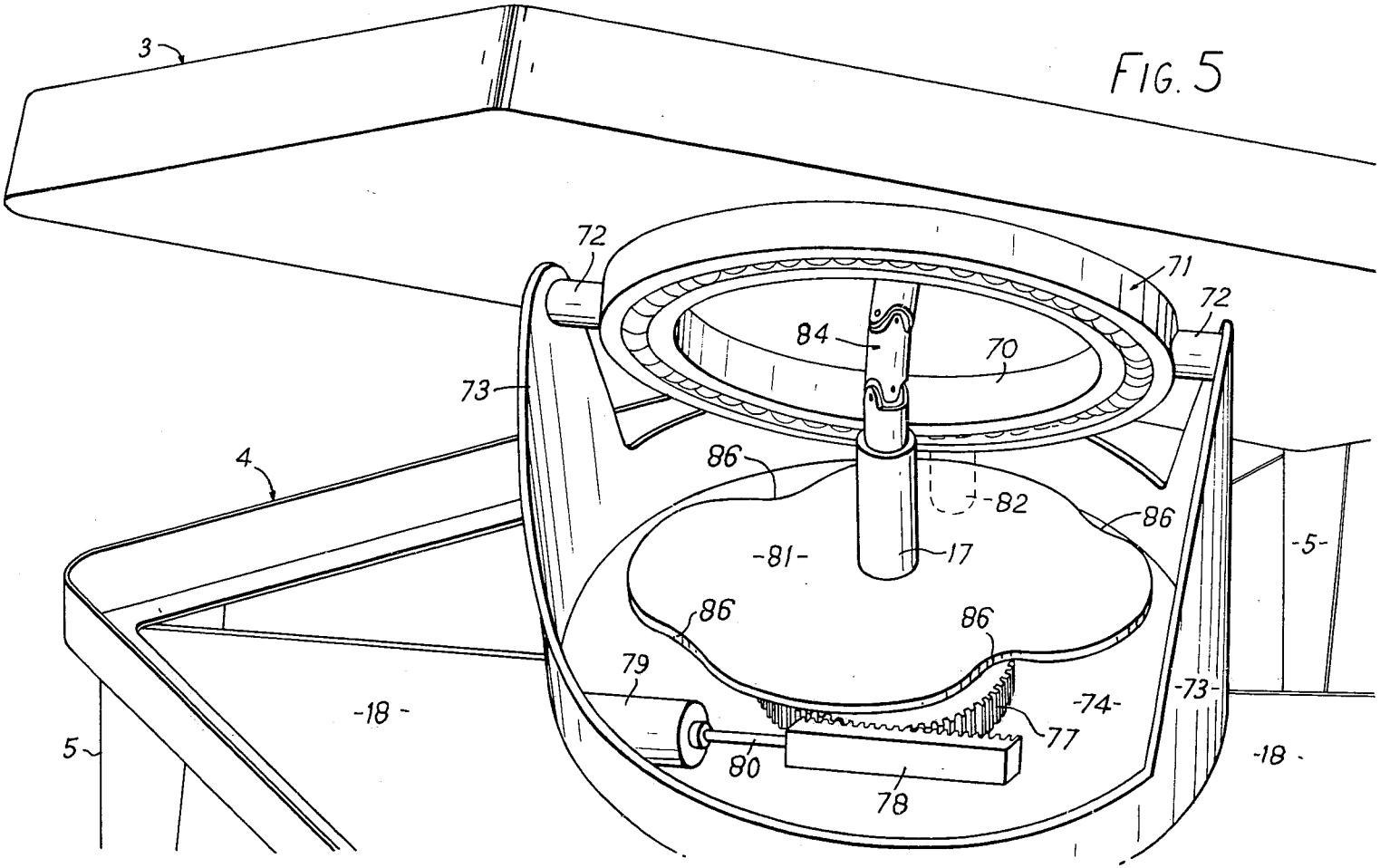

FIGS. 4 and 5 show diagrammatically a modified drive mechanism for the mattress support of FIG. 1. For clarity, the sewing head 2 and its associated carriage 12 have been omitted. It is also to be understood that the mattress support 3 will be as described in FIG. 1 with the exception of its mounting which will now be described.

The mattress support 3 will be mounted on the inner race 70 of a bearing which has capacity for both axial and radial loading. The outer race 71 of this bearing carries a pair of diametrically apposed stub shafts carried in trunnions 72. The trunnions 72 are mounted on upwardly extending arms 73 of a turntable 74. The turntable 74 is mounted on a race 75, which in turn is carried by the four members 18, which cantilever out from each of the four legs 1.

The four members 18 also carry at the centre of the machine, a fixed vertically extending column 17. The turntable 74 is free to rotate about a bearing 76 fixed to the column 17. Also fixed to the column 17 is a spur gear 77. Engaging with the spur gear 77 is a rack 78 which is attached to the piston rod 80 of a fluid operated piston and cylinder motor 79, which is attached to the turntable 74.

Also mounted on the column 17 at a position above the spur gear 77 is a four lobed cam plate 81. A roller 82 engages with the cam plate 81, and is carried on a shaft (not shown) mounted on a bracket 83 which in turn is mounted on the outside of the outer race 71 midway between the trunnions 72.

A universal coupling 84 is secured to the top of the column 17 in such a way that it cannot rotate. The other end of the coupling 84 is secured to the base 85 of the mattress support 3.

It will be apparent that the mattress support 3 is free to tilt with the outer race 71 about an axis through the trunnions 72. The amount of tilt is controlled by the inter-action of the roller 82 with the cam plate 81. It can be described as always having a three point suspension.

The universal coupling 84 is so fixed to the column 17 and the base 85 of the mattress support 3 that when the mattress support 3 is tilted so that it is horizontal, its sides and ends will be parallel with the sides and ends of the carriage track 4. By fixing the universal coupling 84 in this position, there can be no subsequent relative rotation between the mattress support 3 and the table 4. The only motion available then to the mattress support is one of tilt on the axis through the trunnions 72. It is also necessary that the size and shape of the mattress support be identical to the size and shape of the carriage track 4. Thus when the mattress support is tilted about the axis through the trunnions 72, if that axis is parallel to one side of the track 4, then also the side of the mattress support will be parallel to the same side of the track 4.

In operation the sewing head travels round the table on the track 4 at a constant height H. It follows from this, that the necessity of having the point of stitching always at this constant height H above the track 4 determines the shape of the cam plate 81. The cam plate will contain four dwell points 86 which are diametrically opposed and each facing a side or an end of the track 4. In between each dwell point is a lobe on the cam, the radius at any point on a lobe, being proportional to the equivalent diagonal distance from the centre of the mattress support 3 to the corresponding point on the curved sewing edge of the mattress during the course of sewing round a curved corner of the mattress. This situation is illustrated in FIG. 5 where it will be seen that the turntable 74 has made a part rotation between the position facing one side and the subsequent position facing one end of the frame 4.

In operation the turntable 74 is only rotated during the passage of the sewing head round each curved corner of the track and the mattress.

In operation the passage of the sewing head carriage 12 round the curved corner is made to displace an amount of hydraulic fluid directly proportional to the movement round the corner (by a method not shown). This hydraulic fluid is transported to the cylinder 79 which forces out the piston rod 80 and the rack 78. As the rack engages with the fixed gear 77 the reaction causes an equal and opposite rotation of the turntable 74.

Although the mattress support 3 comprising a hollow framework with a moveable floor has been described particularly in connection with the various embodiments of the present invention, it will be understood that it may be used to advantage in the conjunction with previously known mattress tape edge closing machines.

We claim:

1. A mattress tape edge closing machine comprising a mattress support disposed at an acute angle to the horizontal, said support having an edge region, a sewing head arranged to sew in or near the vertical mode and means for causing each part of said edge region of said support to be brought successively into register with said sewing head.

2. A machine according to claim 1 comprising a table carrying said mattress support, said sewing head being moveable around the periphery of the table and the mattress support being pivotally moveable above the table so that successive parts of the edge region are brought into register with corresponding parts of the periphery of the table in synchronism with movement of the sewing head therearound.

3. A machine according to claim 2 in which the mattress support is centrally pivotted above the table and is moveable relative thereto, piston and cylinder fluid motors being provided for effecting such movement.

4. A mattress tape edge closing machine comprising a mattress support disposed at an acute angle to the horizontal and a sewing head arranged to sew in or near the vertical mode and means for causing each part of the edge of the support to be brought successively into register with the sewing head, said means comprising a rotatable turntable, a pair of trunnions bodily carried by said turntable, a member pivotable between the trunnions and rotatably coupled with said mattress support, a shaft, said mattress support being carried centrally on said shaft, an upwardly extending fixed column universally coupled with said shaft, a fixed four lobed cam carried by said column having dwell positions corresponding with the desired locations of the side and end edges of the mattress support relative to the table and a cam follower carried by said member to engage with said cam.

5. A mattress tape edge closing machine comprising a sewing head fixedly mounted to sew in or near the vertical mode and a mattress support disposed at an acute angle to the horizontal, said support having an edge region, said support being continuously rotatable in the same plane so that each part of its edge region successively registers with the sewing head.

6. A machine according to claim 5, comprising a flat base plate, a continuously toothed rack of rectangular formation having a toothed quadrant at each corner carried by said base plate, said mattress support being supported on said base plate, the rack being engageable by a toothed drive wheel and the position of the rack on the table being controlled by a rotatable spindle carried by a variable length link.

7. A machine according to claim 6 comprising a moving pendulum and in which pivotting movement of the mattress support on the table is continuously counterbalanced by said moving pendulum.

8. A mattress tape edge closing machine comprising a mattress support, said support having an edge region and a sewing head, means for bringing each part of said edge region and the sewing head into register, said support comprising an open topped box having a floor moveable from a position at the bottom of the box to a position at the top of the box.

* * * * *